US006086224A

United States Patent [19]

Sugimoto

[11] Patent Number: 6,086,224

[45] Date of Patent: Jul. 11, 2000

[54] LIGHTING UNIT

[75] Inventor: Hiroshi Sugimoto, Osaka, Japan

[73] Assignee: Matsushita Electronics Corporation, Takatsuki, Japan

[21] Appl. No.: 09/193,070

[22] Filed: Nov. 16, 1998

[30] Foreign Application Priority Data

Nov. 21, 1997 [JP] Japan ..... 9-320891

[51] Int. Cl.[7] ..... F21V 17/06

[52] U.S. Cl. ..... 362/267; 362/296; 362/310; 313/113; 313/318.11

[58] Field of Search ..... 313/113, 318.08, 313/318.11; 362/255, 263, 267, 296, 310

[56] References Cited

U.S. PATENT DOCUMENTS

| | | | |
|---|---|---|---|
| 4,156,271 | 5/1979 | Vercellotti | 313/113 |
| 4,219,870 | 8/1980 | Haraden et al. | 362/263 |
| 4,591,752 | 5/1986 | Thouret et al. | 313/113 |
| 4,959,583 | 9/1990 | Arsena et al. | 313/113 |
| 5,568,008 | 10/1996 | Narita | 313/113 |
| 5,806,971 | 9/1998 | Sugihara et al. | 313/318.08 |

FOREIGN PATENT DOCUMENTS 8-212984 8/1996 Japan .

*Primary Examiner*—Alan Cariaso
*Attorney, Agent, or Firm*—Rosenthal & Osha, L.L.P.

[57] ABSTRACT

The present invention provides a lighting unit with a reflecting mirror using a bulb, in which the reflecting mirror will not fall out of a base due to vibration or deterioration of an adhesive by aging. The lighting unit includes a reflecting mirror (1) having a reflecting part (3) at one end and a neck portion (4) at another end, a bulb (11) as a light source, and a base (12). The bulb (11) is positioned inside the reflecting mirror (1). An end of the bulb (11) is inserted into the neck portion (4) of the reflecting mirror (1), and the base (12) is fixed to the neck portion (4). Thus, the bulb (11), the reflecting mirror (1), and the base (12) are combined into one component. The maximum outer diameter of the bulb (11) is larger than an inner diameter of the neck portion (4) of the reflecting mirror (1).

8 Claims, 4 Drawing Sheets

LIGHTING UNIT

FIELD OF THE INVENTION

The present invention relates to a lighting unit with a reflecting mirror using a bulb, for example, used for lighting up goods at a shop or the like.

BACKGROUND OF THE INVENTION

A tungsten halogen lamp used in a lighting unit with a dichroic mirror used for lighting up goods at a shop or the like is proposed as a bulb used in a lighting unit with a reflecting mirror.

As shown in FIG. 3, in a lighting unit with a dichroic mirror, a funnel-shape reflecting mirror 1 and a bulb as a light source, for example, a tungsten halogen lamp 20 are combined into one component with the central axis of the reflecting mirror 1 approximately coinciding with that of the tungsten halogen lamp 20. The reflecting mirror 1 comprises a reflecting part 3 having a reflecting-mirror surface provided with a dichroic film 2 at one end and a neck portion 4 at another end. The neck portion 4 is connected to the reflecting part 3. The tungsten halogen lamp 20 has a straight-tube shape and is sealed at one end. A sealing portion 21 of the tungsten halogen lamp 20 is inserted into the neck portion 4 of the reflecting mirror 1. Further, the sealing portion 21 and the neck portion 4 are inserted into a base 12, and an adhesive 17 is injected into the base 12, thus fixing the parts so as to form one component.

However, when the conventional lighting unit with a dichroic mirror using the tungsten halogen lamp is lighted up with the reflecting mirror 1 positioned downward for many hours, the adhesive 17 injected into the base 12 for fixing the reflecting mirror 1, the tungsten halogen lamp 20, and the base 12 deteriorate. Thus, the adhesive strength decreases, and the reflecting mirror 1 therefore falls out as shown in FIG. 4. As a result, a lighted object can be damaged in some cases. Consequently, there has been a problem in safety.

Even if the adhesive 17 does not deteriorate, the adhesive strength also decreases due to vibration for a long period and therefore the reflecting mirror 1 falls out in some cases.

SUMMARY OF THE INVENTION

The present invention aims to solve problems such as those described above. It is an object of the present invention to provide a lighting unit with a reflecting mirror using a bulb, in which the reflecting mirror will not fall out of a base due to vibration or deterioration of an adhesive by aging.

In order to attain the object described above, a lighting unit of the present invention comprises a reflecting mirror having a reflecting part at one end and a neck portion at another end, a bulb as a light source, and a base. The bulb is positioned inside the reflecting mirror. An end of the bulb is inserted into the neck portion of the reflecting mirror, and the base is fixed to the neck portion, thus combining the bulb, the reflecting mirror, and the base into one component. The maximum outer diameter of the bulb positioned inside the reflecting mirror is larger than an inner diameter of the neck portion of the reflecting mirror.

In the lighting unit described above, it is preferable that the maximum outer diameter of the bulb is at least 1.02 times larger than the inner diameter of the neck portion of the reflecting mirror. According to this preferable example, even if the reflecting mirror falls out, the reflecting mirror is caught by a part of the bulb having the maximum outer diameter, thus effectively preventing the reflecting mirror from falling.

In the lighting unit described above, it is preferable that the bulb as light source is a tungsten halogen lamp. According to this preferable example, bright lighting can be provided.

In the lighting unit described above, it is preferable that the bulb has a swelling part with a spheroid-shape. According to this preferable example, even if the reflecting mirror falls out, the bulb is not greatly damaged. Therefore, damage to the bulb can be prevented, and it is possible to effectively prevent the reflecting mirror from falling.

In the lighting unit described above, it is preferable that the base is fixed to the neck portion of the reflecting mirror using an adhesive. According to this preferable example, it is easy to fix the base to the neck portion.

In the lighting unit described above, it is preferable that the adhesive is an inorganic adhesive. According to this preferable example, the adhesive can resist high temperature.

In the lighting unit described above, it is preferable that a narrowed-down part is provided to the bulb between a part having the maximum outer diameter of the bulb and a part inserted into the neck portion of the reflecting mirror. According to this preferable example, the swelling part comes to have a shape more similar to a spherical shape. Therefore, the strength of the bulb can be further increased.

In the lighting unit described above, it is preferable that the narrowed-down part has an outer diameter in a range of 60 to 80% of the maximum outer diameter of the bulb. According to this preferable example, the strength of the bulb can be further increased.

Furthermore, in the lighting unit described above, it is preferable that the bulb has a thickness in a range of 0.7 to 1.13 mm. According to this preferable example, the strength of the bulb can be further increased.

In the lighting unit described above, the bulb has such strength that the bulb does not break even if the reflecting mirror having a weight of 55 g falls in a vertical direction by 0.9 cm.

According to the present invention, even if the adhesive strength decreases and the reflecting mirror falls out, the neck portion of the reflecting mirror having a smaller diameter is caught by the part having a larger diameter of the bulb located inside the reflecting mirror, thus preventing the reflecting mirror from falling.

DETAILED DESCRIPTION OF THE INVENTION

The present invention will be described further below with reference to drawings.

Figure 1:
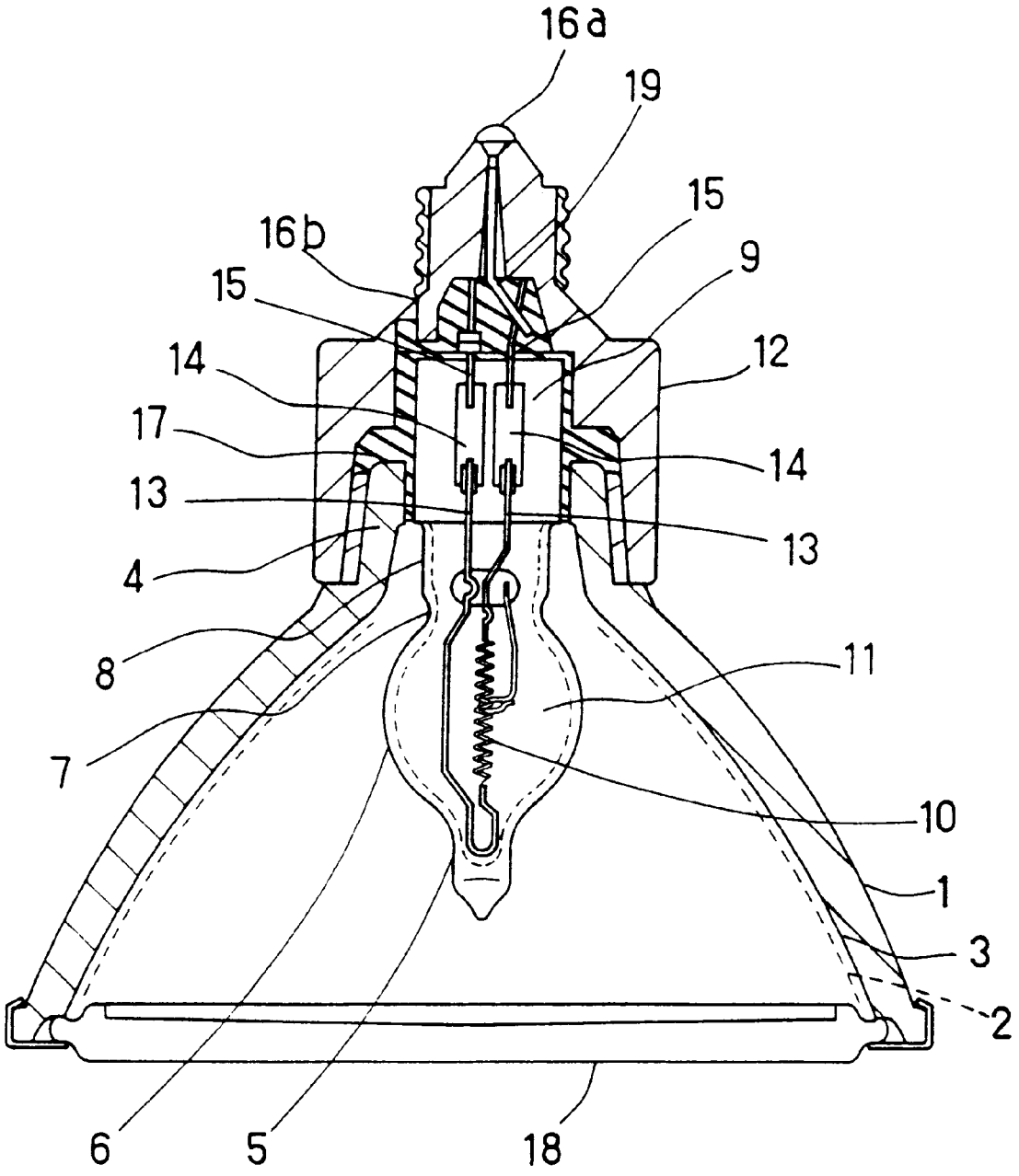
FIG. 1 is a sectional view of a lighting unit with a reflecting mirror of one embodiment according to the present invention.

A lighting unit with a dichroic mirror of one embodiment of the present invention comprises a funnel-shape reflecting mirror 1 having a reflecting part 3 at one end and a neck portion 4 at another end, a tungsten halogen lamp 11 (a light source) and a base 12 as shown in FIG. 1. The reflecting part 3 has an opening diameter of 70 mm and a reflecting-mirror surface provided with a dichroic film 2 as a light interference film. The neck portion 4 has an inner diameter of 12 mm and is connected to the reflecting part 3. In the tungsten halogen lamp 11, a closed part 5, a swelling part 6 having a spheroid-shape, a narrowed-down part 7, a cylindrical part 8, and a sealing portion 9 are provided sequentially. A tungsten filament 10 is provided inside the swelling part 6. The base consists mainly of zircon cordierite.

The dichroic film 2 is a light interference film formed by laminating a high-refractive layer made of zinc sulphide (ZnS) and a low-refractive layer made of magnesium fluoride alternately. Light emitted from the light source is reflected by or passes through the dichroic film 2 selectively. The dichroic film 2 reflects a visible light to the front direction of the mirror, and an infrared ray passes through the dichroic film 2 to the back of the mirror.

The filament 10 is provided with a filament axis approximately coinciding with the center axis of the tungsten halogen lamp 11. The tungsten halogen lamp 11 is inserted into the reflecting mirror 1 with the filament axis approximately coinciding with the center axis of the reflecting mirror 1.

The sealing portion 9 of the tungsten halogen lamp 11 is inserted into the neck portion 4 of the reflecting mirror 1. The neck portion 4 and the sealing portion 9 are inserted into the base 12. The heat-resistant adhesive 17, for example, an inorganic adhesive comprising silica and alumina as main components is injected into the base 12. Thus, the reflecting mirror 1, the tungsten halogen lamp 11, and the base 12 are combined into one component.

Inside the sealing portion 9, a part of each internal lead wire 13 for holding the filament 10, metal foils 14 connected to the internal lead wires 13, and a part of each outer lead wire 15 are sealed. The other ends of the outer lead wires 15 are lead to the outside of the sealing portion 9 and are electrically connected to power supply parts 16*a* and 16*b* of the base 12 respectively.

Further, one of the outer lead wires 15 and the power supply part 16*a* of the base 12 are connected via a lead wire 19 formed of a nickel wire having a diameter of 0.4 mm. Therefore, the tungsten halogen lamp 11 does not fall out from the base 12, even if the reflecting mirror 1 falls out and is caught by the swelling part 6 having a spheroid-shape of the tungsten halogen lamp 11.

Such a lighting unit with a dichroic mirror of the present embodiment (hereafter, referred to as "an invented item") has a rated voltage of 110V an electricity of 60W, a luminous intensity of 4500 cd at the center, and a beam angle of 22°. A straight portion at the root of the tungsten halogen lamp 11 has an outer diameter of 9.0 mm. The swelling part 6 of the tungsten halogen lamp 11 has the maximum outer diameter of 14 mm. The narrowed-down portion 7 between the straight portion and the swelling part 6 has an outer diameter of 8.3 mm and a thickness of 0.9 mm. The sealing portion 9 has a length of 11.5 mm and a width of 10 mm. The lamp has a length of 53 mm. A predetermined amount of halogenated compound and argon gas is sealed inside the tungsten halogen lamp 11. A material of the tungsten halogen lamp 11 is quartz. Numeral 18 indicates a front glass. The reflecting mirror 1 has a weight of 55 g.

Such an invented item was lighted up with the reflecting mirror 1 positioned downward, and variation test and life test were carried out.

Figure 2:
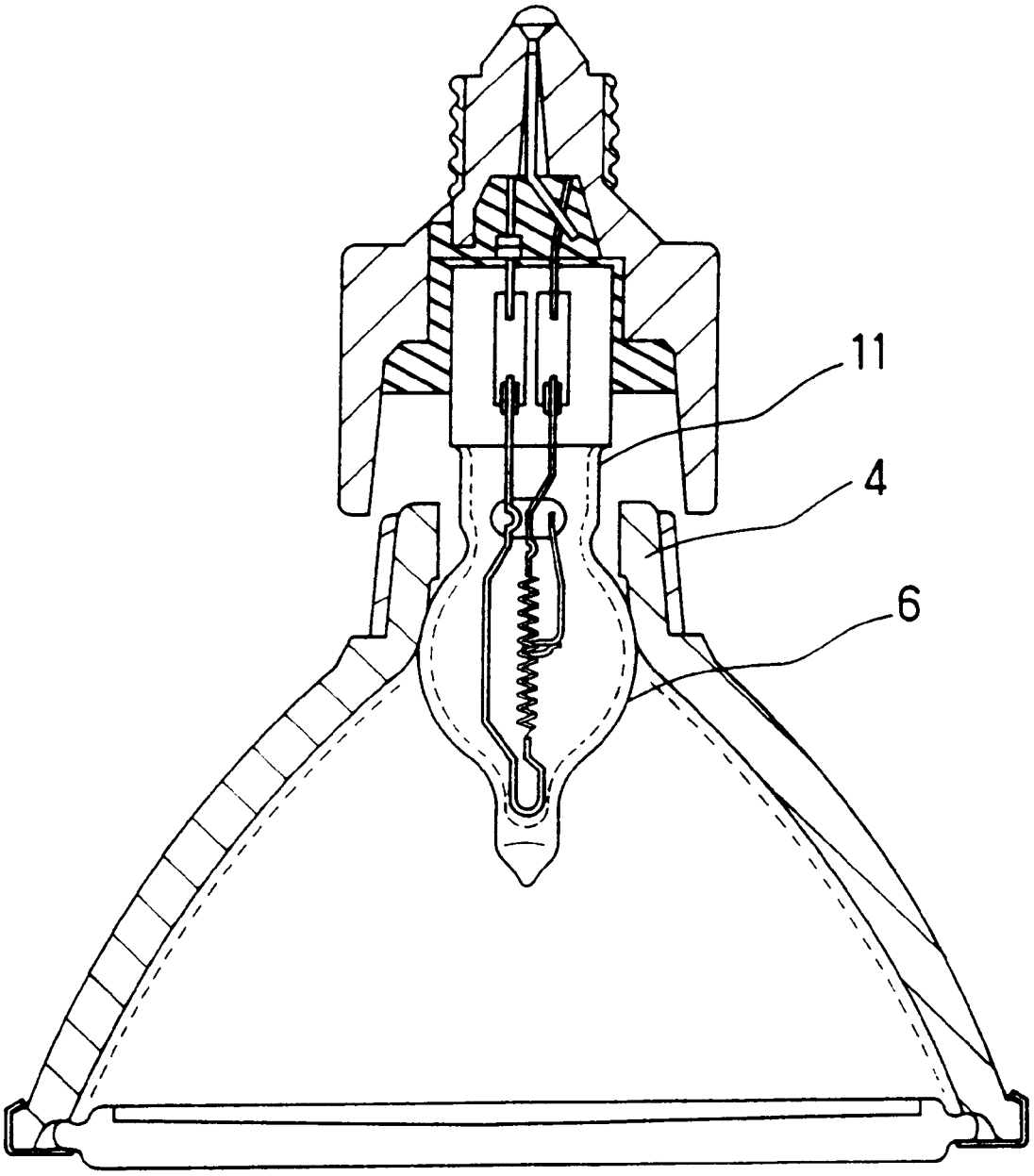
FIG. 2 is a sectional view illustrating the case where the reflecting mirror comes off a base in the embodiment of the present invention.
Figure 3:
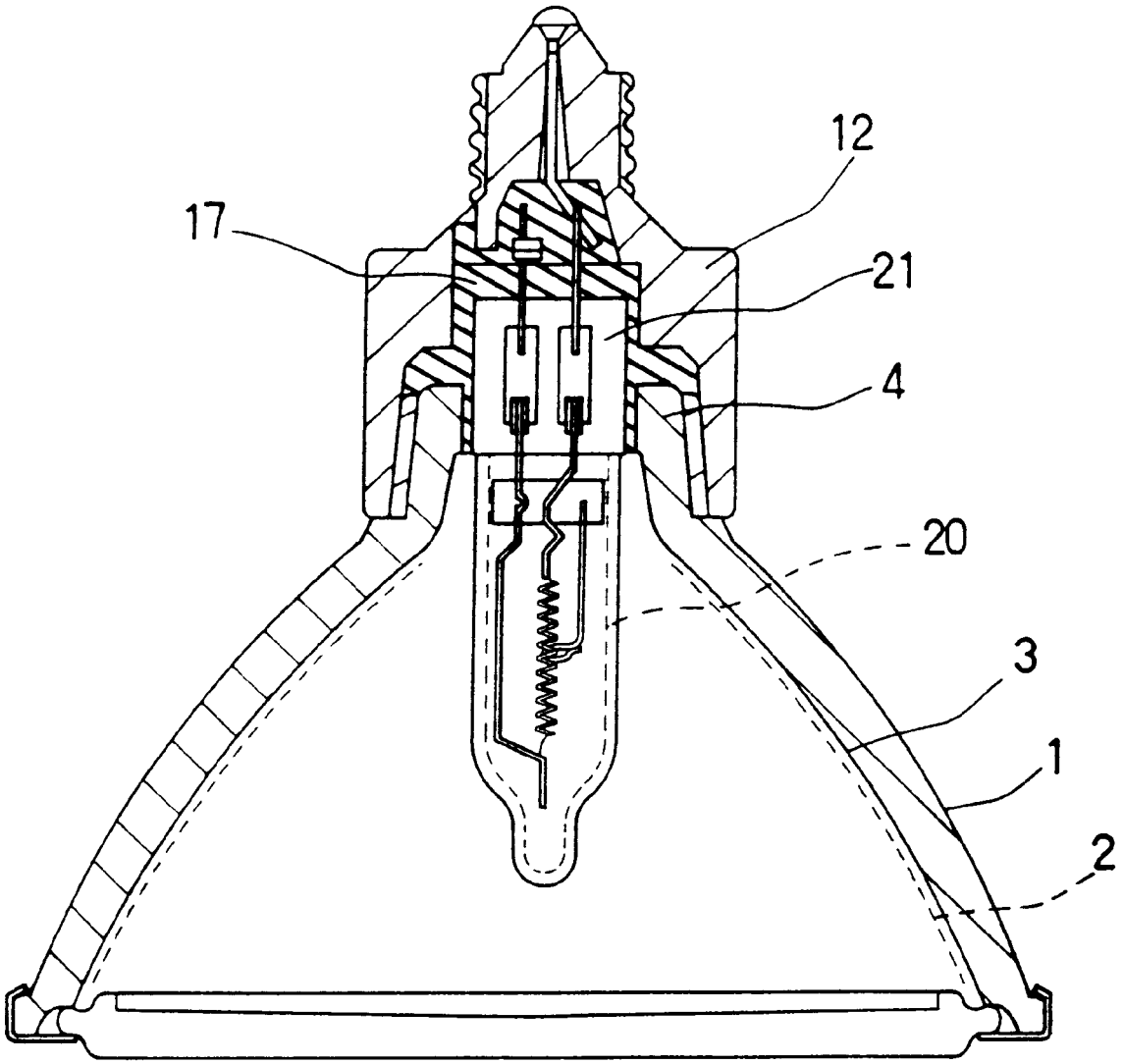
FIG. 3 is a sectional view of a conventional lighting unit with a reflecting mirror.
Figure 4:
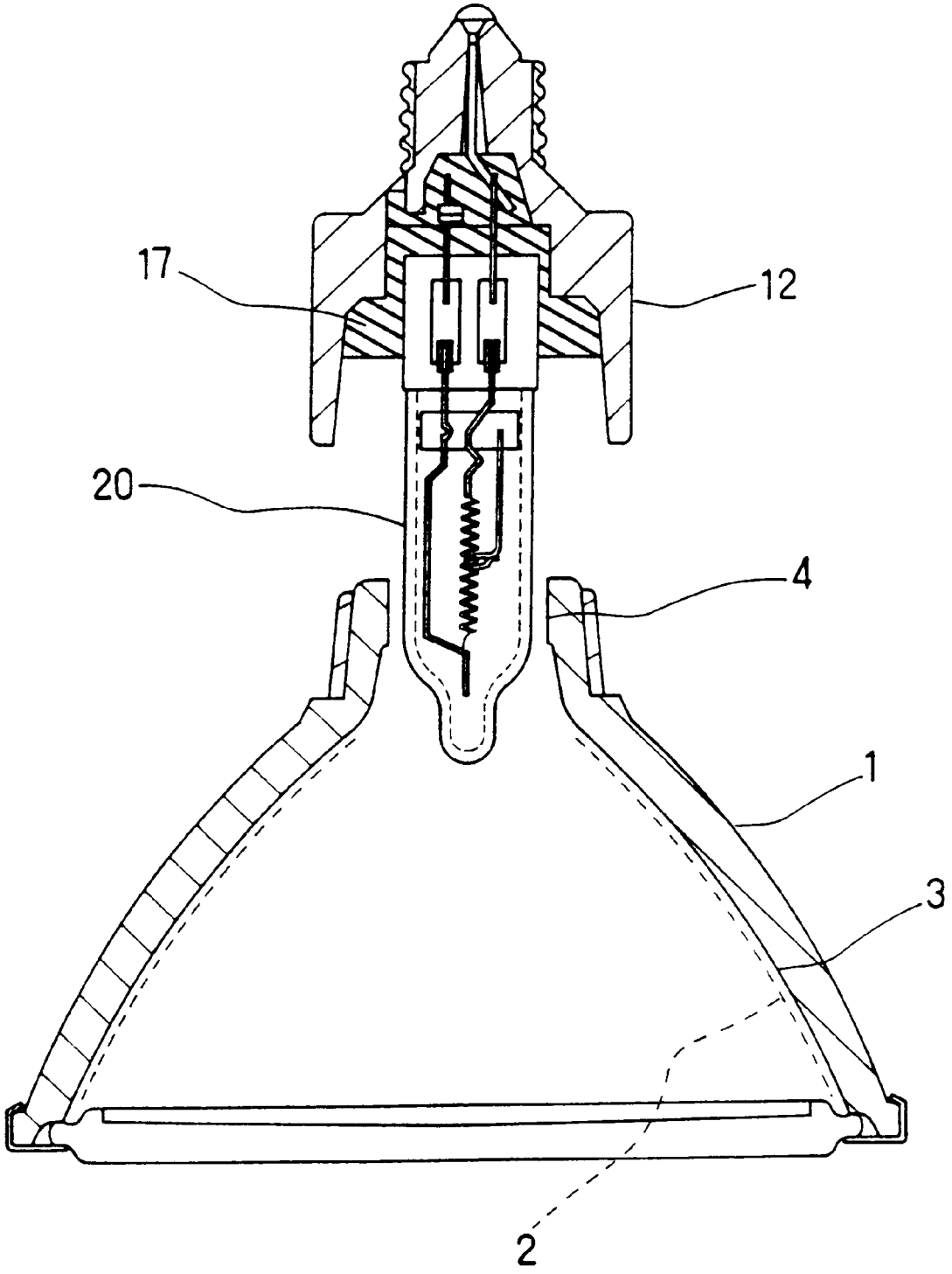
FIG. 4 is a sectional view illustrating the case where the reflecting mirror comes off a base in the conventional lighting unit.

As a result, even if the reflecting mirror 1 falls out from the base 12 due to strong vibration or due to decrease in adhesive strength or deterioration of the adhesive 17 caused by the lighting for 2000 hours, i.e., its rating life, the swelling part 6 of the tungsten halogen lamp 11 catches the neck portion 4 of the reflecting mirror 1 as shown in FIG. 2, thus preventing the reflecting mirror 1 from falling. Since the outer diameter of a part of the tungsten halogen lamp 11 located inside the reflecting mirror 1 is larger than the inner diameter of the neck portion 4 of the reflecting mirror 1, the neck portion 4 having a smaller diameter is caught by a part of the swelling part 6 having a larger diameter of the light source located inside the reflecting mirror 1, thus preventing the reflecting mirror 1 from falling As described above, the bulb used in a lighting unit with a reflecting mirror of the present invention can prevent the reflecting mirror from falling, even if the reflecting mirror falls out from the base when the bulb is lighted up with the reflecting mirror positioned downward. Therefore, damage to the lighted goods can be avoided, thus improving the practical safety.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A lighting unit comprising:

a reflecting mirror, which has a reflecting part at one end and a neck portion at another end;

a bulb as a light source, which is positioned inside the reflecting mirror, an end of the bulb being inserted into the neck portion of the reflecting mirror; and a base, which is fixed to the neck portion, wherein the bulb, the reflecting mirror, and the base are combined into one component, a maximum outer diameter of the bulb is larger than an inner diameter of the neck portion of the reflecting mirror, a narrowed-down part is formed on the bulb between a part having the maximum outer diameter of the bulb and a part inserted into the neck portion of the reflecting mirror to allow the swelling part of the bulb to have a shape more similar to a spherical shape and thus strength of the bulb is increased, and the bulb has a wall thickness in a range of 0.7 to 1.13 mm.

2. The lighting unit according to claim 1, wherein the maximum outer diameter of the bulb is at least 1.02 times larger than the inner diameter of the neck portion of the reflecting mirror.

3. The lighting unit according to claim 1, wherein the bulb as a light source is a tungsten halogen lamp.

4. The lighting unit according to claim 1, wherein the bulb has a swelling part with a spheroid-shape.

5. The lighting unit according to claim 1, wherein the base is fixed to the neck portion of the reflecting mirror using an adhesive.

6. The lighting unit according to claim 5, wherein the adhesive is an inorganic adhesive.

7. The lighting unit according to claim 1, wherein the narrowed-down part has an outer diameter in a range of 60 to 80% of the maximum outer diameter of the bulb.

8. The lighting unit according to claim 1, wherein the reflecting mirror has a weight of 55 g and the bulb has such strength that the bulb does not break even if the reflecting mirror falls in a vertical direction by 0.9 cm.

* * * * *